US005353104A

United States Patent [19]

Kato et al.

[11] Patent Number: 5,353,104

[45] Date of Patent: Oct. 4, 1994

[54] DEFINING MEMBER FOR DEFINING THICKNESS OF ONE-COMPONENT DEVELOPER AND DEVELOPING DEVICE EQUIPPED WITH IT

[75] Inventors: Junichi Kato, Sagamihara; Masaharu Ohkubo, Yokohama; Masahiro Watabe, Yokohama; Noriyuki Yanai, Yokohama; Masaki Ojima, Inagi; Hiroshi Sato, Tokyo, all of Japan

[73] Assignee: Canon Kabushiki Kaisha, Tokyo, Japan

[21] Appl. No.: 18,715

[22] Filed: Feb. 17, 1993

[30] Foreign Application Priority Data

Feb. 20, 1992 [JP] Japan ..... 4-069330

[51] Int. Cl.[5] ..... G03G 15/06

[52] U.S. Cl. ..... 355/259; 118/651; 118/657; 118/661; 355/251; 355/253

[58] Field of Search ..... 355/245, 246, 351, 269, 355/253, 259; 118/656, 658, 651, 653, 657, 644, 661

[56] References Cited

U.S. PATENT DOCUMENTS 5,122,838 6/1992 Kohyama ..... 355/269
5,177,537 1/1993 Okano et al. ..... 355/253 X
5,220,129 6/1993 Nishio et al. ..... 355/251
5,221,946 6/1993 Kohyama ..... 118/656 X
5,235,387 8/1993 Sato et al. ..... 355/245

FOREIGN PATENT DOCUMENTS 85045272 8/1983 Japan .
87024282 7/1985 Japan .
88221369 3/1987 Japan .

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An elastic blade which is maintained in contact with the developing sleeve for defining the thickness of one-component developer to be transported by the developing sleeve to a developing area, is composed of an elastic base member, and a surface layer coated thereon and giving friction on the one-component developer, and the surface layer contains a substance chargeable frictionally to a polarity opposite to the triboelectric polarity of the one-component developer and another substance chargeable frictionally to a polarity the same as the triboelectric polarity of the one-component developer, and is charged frictionally, in total, to a polarity opposite to the polarity of the one-component developer.

27 Claims, 5 Drawing Sheets

DEFINING MEMBER FOR DEFINING THICKNESS OF ONE-COMPONENT DEVELOPER AND DEVELOPING DEVICE EQUIPPED WITH IT

BACKGROUND OF THE INVENTION

1. Field of the Invention

The present invention relates to an improved defining member for defining the thickness of a layer of a one-component developer employed for developing an electrostatic latent image, and a developing device equipped with said defining member.

2. Related Background Art

FIG. 6 is a schematic view of a known developing device, wherein a developing sleeve 21, composed of a non-magnetic pipe made for example, of aluminum or stainless steel and serving as a developer bearing member, is provided in a developing container 23 containing a magentic toner 24 constituting one-component developer, at an aperture opposed to an electrophotographic photosensitive member (image bearing member, not shown). Inside said developing sleeve 21, there is unmovably fixed a magnet 22 having plural magnetic poles N, S in an alternating manner, and the toner 24 in the developing container is supported on the surface of the sleeve 21 rotating in the direction indicated by an arrow, by the magnetic function of said magnet 22.

An elastic blade 26, serving as a developer defining member, is mounted on a supporting plate 27, and extends in the opposite direction to the rotating direction of the developing sleeve 21 and elastically contacts, at a lateral face of the free end, the surface of the developing sleeve 21, whereby a nip 12 is formed between the blade 26 and the sleeve 21.

The blade (defining member) 26 directly contacts the sleeve 21 in the absence of the developer, but contacts the developer, instead of the sleeve 21, in case the developer is present on the sleeve 21. In the latter case, however, the blade 26 elastically presses the thin layer of developer to the sleeve 21. Consequently, in the present text, the blade (defining member) is represented as being in contact with the sleeve (developer supporting member).

The elastic blade 26 is in general composed of urethane rubber, silicone rubber or butyl rubber. The toner 24 supported on the developing sleeve 21 is defined in thickness, in passing said nip, whereby a thin toner layer 25 is formed on the developing sleeve 21.

The toner layer 25 supported on said developing sleeve 21 is transported, by the rotation of the developing sleeve 21, to a developing area where the sleeve 21 is positioned close to the image bearing member, and the toner 24 is supplied and deposited on the latent image formed on said image bearing member. Thus, the development of said latent image is achieved.

The lower part of the toner layer 25 on said developing sleeve 21 is sufficiently friction charged to a polarity required for the development of the latent image, by the contact with the developing sleeve 21. On the other hand, the upper part of the toner layer 25 is given a charge by friction charging in contact with the elastic blade 26, but sufficient frictional charge is often not obtained by such blade 26 composed, for example, of urethane rubber. For this reason, the amount of frictional charge in the toner 24 may be significantly different between the upper and lower parts of the toner layer 25, and such charge distribution often leads to drawbacks such as the ghost phenomenon in the developed image or a low image density due to the deficient charge amount in the upper part of the toner image 25.

Such drawbacks tend to appear in the initial stage of operation of the developing device or immediately after the replenishment of toner 24 into the developing container 23, when the frequency of contacts of toner 24 with the developing sleeve 21 is still limited. Such drawbacks are also encountered when the particle size of the toner 24 is small, because this increases the proportion of toner which is transported to the developing area without sufficient contact with the developing sleeve 21.

To avoid these drawbacks, there has been proposed a method of increasing the contact pressure of the elastic blade 26 with the developing sleeve 21, thereby pressing the toner 24 more strongly to the surface of said sleeve 21, but the toner 24 tends to be adhered in the nip 12 between the blade 26 and the developing sleeve 21, thereby generating streak-shaped unevenness in the toner layer 25.

Also as an alternative method, Japanese Patent Laid-open No. 62-24282 proposes a method of adding a charge control substance in the elastic blade 26. However, if the content of such charge control substance is low in the blade 26, there cannot be obtained the anticipated effect because the charge control substance does not appear on the surface of the elastic blade 26. Though such effect can be obtained by an increase in said content, the elastic blade 26 becomes incapable of exhibiting sufficient elasticity, thus becoming unable to provide a uniform and sufficient contact pressure on the developing sleeve 21.

Furthermore, Japanese Patent Laid-open No. 60-45272 proposed a method of coating a charge control substance on the surface of the elastic blade 26, in order to effect sufficient frictional charging on the toner 24 without losing the rubber elasticity of the elastic blade 26, thereby providing the toner 24 with a sufficient charge. In this proposal, in consideration of the triboelectric series with the toner 24, the charge control substance is selected for example from styrene resin, acrylic resin, polyester resin, epoxy resin, polyamide resin, fluorinated resin, silicone resin or polycarbonate resin.

However, if the charge control substance coated on the elastic blade 26 is poor in lubricating property, said charge control substance may be peeled off by the sliding contact with the developing sleeve 21, particularly in the initial stage of use when the elastic blade 26 is in direct contact with the developing sleeve 21. Also, the poor lubricating character of such charge control substance hinders smooth transportation of the toner 24 by the developing sleeve 21, whereby the toner staying at the elastic blade 26 is excessively charged, thus resulting in a loss in the density, or in speckles on the obtained image due to the coagulation of toner on the developing sleeve 21.

For this reason, Japanese Patent Laid-open No. 63-221369 proposes a method of forming the elastic blade itself with synthetic resin other than rubber and mixing particles of different resin in the resin constituting the blade 26, thereby stabilizing the coating of the toner 24.

However, in order to define the thickness of the toner layer for a prolonged period and to provide the toner 24 with a charge, a considerably high contact pressure to the sleeve has to be given to the elastic blade 26, and the resin blade 26 containing particles of different resin in the entire blade cannot exhibit sufficient elasticity, thus being unable to maintain a uniform and sufficient contact pressure.

SUMMARY OF THE INVENTION

An object of the present invention is to provide a defining member, for defining the thickness of layer of the developer, capable of satisfactory frictional charging of a one-component developer while contacting the developer bearing member with a uniform and sufficient pressure over a prolonged period, and a developing device equipped with said defining member.

Another object of the present invention is to provide a defining member, for defining the thickness of layer of the developer, capable of appropriate frictional charging of a one-component developer, without excessive charging even under a low humidity condition, while contacting the developer bearing member with a uniform and sufficient pressure over a prolonged period, and a developing device equipped with said defining member.

Still another object of the present invention is to provide a defining member, for defining the thickness of layer of the developer, capable of satisfactory frictional charging of a one-component developer, even immediately after the start of use of the developing device or immediately after the replenishment of the developer, and a developing device equipped with said defining member.

Still other objects of the present invention, and the features thereof, will become fully apparent from the following description.

DETAILED DESCRIPTION OF THE PREFERRED EMBODIMENTS

Figure 1:
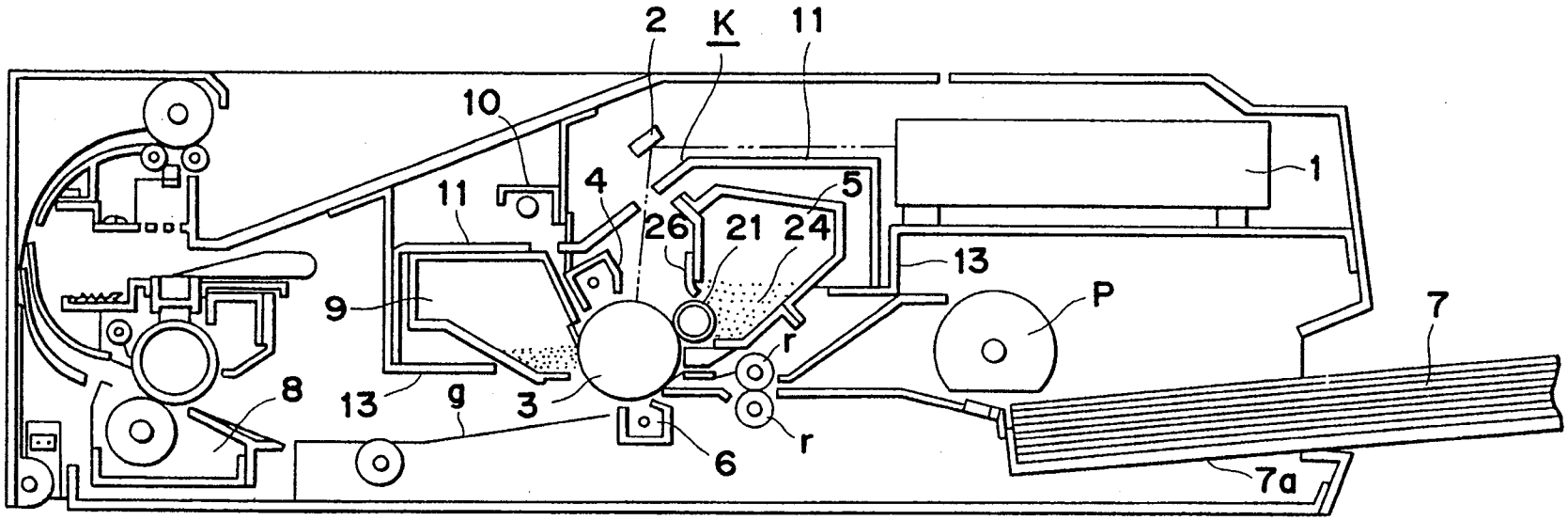
FIG. 1 is a schematic view of an electrophotographic apparatus in which the present invention is applicable.

FIG. 1 is a schematic view of an image forming apparatus in which the present invention is applicable.

The image forming apparatus is equipped, as shown in FIG. 1, with a scanner unit 1 including a laser, a polygon mirror, and a correcting lens system. Scanner unit 1 emits a laser beam modulated according to image signal, and the laser beam is reflected by a mirror 2 and irradiates an electrophotographic photosensitive drum 3 serving as an image bearing member. Photosensitive drum 3 is composed, for example of OPC (organic photoconductor), and is uniformly charged in advance negatively by a primary charger 4 consisting of a corona charger. The photosensitive drum 3 is exposed to the laser beam to form an electrostatic latent image thereon. The electrostatic latent image formed on the photosensitive drum 3 is subjected to reversal development with magnetic toner 24 serving as a one-component developer and contained in a developing unit 5, thereby providing a visible toner image.

On the other hand, a recording material 7 such as plain paper or plastic sheet, contained in a cassette 7*a* is advanced by a feed roller p to temporarily stopped registration rollers r in synchronization with the formation of the electrostatic latent image on the photosensitive drum 3. The registration rollers r advance the recording material 7 to a positive transfer charger 6, consisting of a corona charger, in synchronization with the front end of the toner image formed on the photosensitive drum After being subjected to the transfer of the toner image by the transfer charger 6, the recording material 7 is transported to a fixing unit 8 along a transport guide 8. After the toner image is permanently fixed, the recording material 7 is discharged from the image forming apparatus.

The toner 24 remaining on the photosensitive drum 3 is removed by a cleaner 9, and the drum 3 is then exposed to the light of a pre-exposure unit 10 consisting of a halogen lamp, for eliminating the hysteresis of charging.

Said photosensitive drum 3, primary charger 4, developing unit 5, cleaner 9 and a cover 11 are integrally formed as a process cartridge K, which detachably mounted in the image forming apparatus, along guide members 13. Cover 11 serves to protect the photosensitive drum 3 from light and dusts when the cartridge K is detached from the image forming apparatus.

Figure 2:
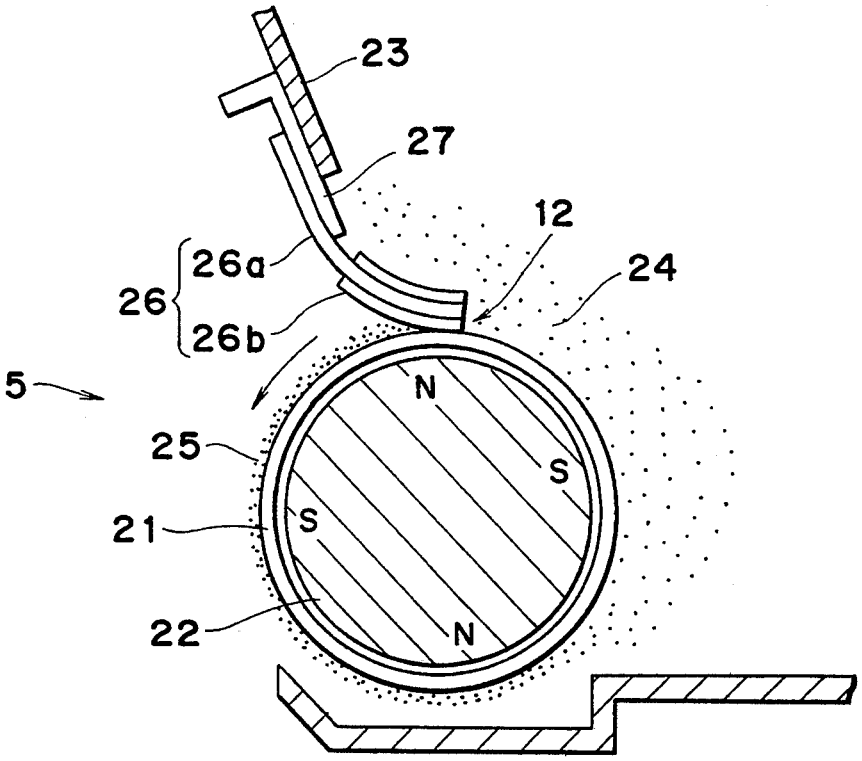
FIG. 2 is a partial cross-sectional view of an embodiment of the present invention.
Figure 6:
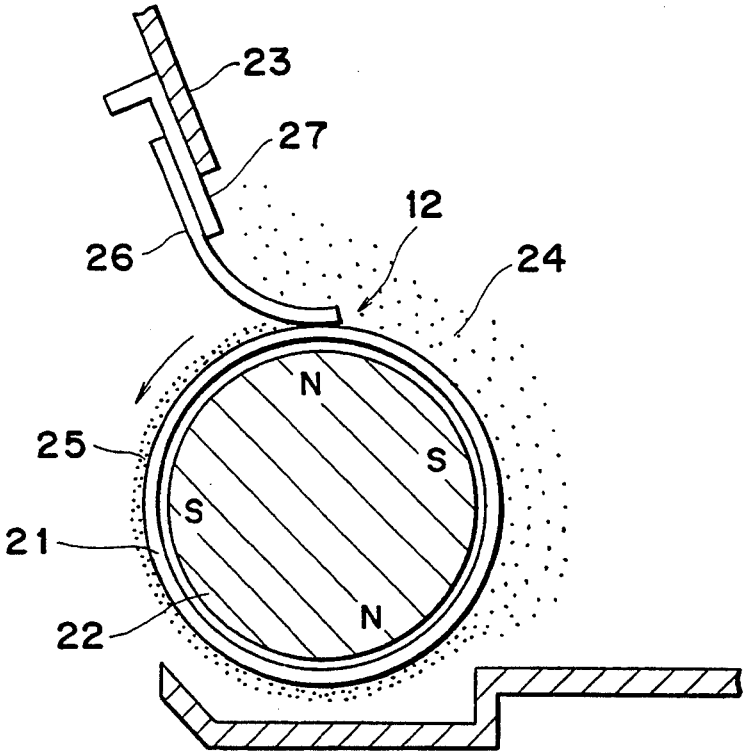
FIG. 6 PRIOR ART
FIG. 6 is a partial cross-sectional view of a conventional developing device.

FIG. 2 shows a developing device embodying the present invention. As in the conventional developing device shown in FIG. 6, a developing sleeve 21 is rotatably provided at an aperture, opposed to the photosensitive drum 3 shown in FIG. 2, of a developing container 23 containing the magnetic toner 24 serving as the one-component developer, and, inside said developing sleeve 21, there is unmovably provided a magnet 22 with plural magnetic poles N, S in an alternating manner. An elastic blade 26 is mounted on a supporting plate 27.

The elastic blade 26 extends in the opposite direction to (or in the same direction as) the rotating direction, indicated by an arrow, of the developing sleeve 21, and elastically contacts, at a lateral face of the free end, the developing sleeve 21, whereby a nip is formed between the blade 26 and the sleeve 21.

The toner is defined in thickness in passing the nip 12, whereby a thin toner layer 25 is formed on the developing sleeve 21 and is transported to a developing area. The toner 24 acquires a frictional charge of a predetermined polarity, for developing the latent image, by means of the friction with the developing sleeve 21. Frictional charging takes place most actively at the defining by the elastic blade 26. Also upon passing said nip 12, the surface of the toner layer is charged to the predetermined polarity by the friction with the blade 26.

As the present embodiment employs reversal development of the negative electrostatic latent image, in which the toner is deposited in the exposed area of the latent image, the toner is negatively charged by friction.

Elastic blade 26 is composed of a rubber base blade member 26*a*, on which a flexible surface layer 26*b* is coated. Surface layer 26*b* comes into contact with the sleeve 21, thereby forming the nip 12. Therefore the surface layer 26*b* is in sliding contact with the toner layer. The base blade member 26*a* has rubber elasticity, and the elastic force thereof causes the surface layer 26*b* to elastically contact the sleeve 21 with a uniform and sufficient pressure.

In the following description there will be explained an example of the elastic blade 26 having the surface layer 26b which contains a first substance charged in a polarity opposite to said predetermined polarity by friction with the one-component developer and a second substance charged in the same polarity as said predetermined polarity by the friction with said one-component developer and which is in total charged to the polarity opposite to said predetermined polarity by the friction with the one-component developer.

In the foregoing example, the toner is friction charged negatively. An example of the resin charged positively by the friction with the toner 24 is polyamide resin. Stated differently, the toner 24 acquires a negative frictional charge by friction with the polyamide resin.

Another example of the resin charged negatively by the friction with the toner 24 is polyvinyl chloride resin. Stated differently, the toner 24 acquires positive frictional charge by friction with the polyvinyl chloride resin.

Thus, in a surface layer 26b in which powdered polyvinyl chloride is dispersed in the polyamide resin as a binder, as a result of friction with the toner 24, the polyvinyl chloride resin powder exposed on the surface of the surface layer is negatively charged, while the polyamide resin on the surface of said surface layer is positively charged. By dispersing a suitable amount of polyvinyl chloride resin powder in said binder, the surface layer 26b is charged, positively in total, by the friction with the toner 24. More specifically, by the friction with the toner 24, the surface layer 26b acquires both positive and negative frictional charges, but the former is larger than the latter so that the potential to the exterior does not become negative but positive. Naturally the positive surface potential of the surface layer 26b, resulting from the frictional charging, is lower when the powdered polyvinyl chloride is dispersed inside the surface layer than in the case in which said powder is not dispersed inside.

Consequently, the surface portion of the toner 24 is charged, negatively in total, by friction with said surface layer 26b.

Stated differently, the toner acquires a negative charge by the polyamide resin of the surface layer 26b and a positive charge by the powdered polyvinyl chloride resin exposed on the surface of the surface layer 26b. However, because of the above-mentioned reason, the frictional charge acquired by the toner is larger in the negative charge than in the positive charge. Consequently, the toner behaves in total as if it is negatively charged. However the negative potential of the toner is lower when it is rubbed with said surface layer 26b than in the case when it is rubbed with polyamide resin only.

Therefore, the frictional charging of toner with the above-mentioned surface layer 26b avoids excessive charging of toner even under a low humidity condition, thereby enabling the apparatus of the present invention to obtain a developed image of a high density, without ghost or background smudge.

Thus, in the nip part, the lower part of the toner layer is adequately charged to a predetermined polarity by the friction with the sleeve 21, while the upper part of the toner layer is adequately charged the predetermined polarity by the friction with the surface layer 26b of the blade 26, whereby the toner layer acquires a frictional charge of an adequate amount in total.

In the following description there will be explained a specific example of another preferred embodiment of the present invention The development sleeve 21 was prepared by roughing the surface of an aluminum pipe of a diameter of 16 mm with alundum particles of #100 mesh and a magnet 22 with four magnetic poles of 600–850 Gauss placed therein. Negatively chargeable toner 24 was prepared by blending magnetite in 10% in styrene-acrylic resin, crushing it to a particle size distribution of 5–8 μm and adding silica in an amount of 1.2 wt. % as an additive.

For the elastic blade 26, there was employed a base blade member 26a of urethane rubber of a thickness of 1.3 mm and a hardness of 65° (JIS-A). Alcohol-soluble polyamide resin such as Platamid (manufactured by Nippon Rilsan) or Toresin (Teikoku Kagaku Sangyo) was prepared as a methanol solution with a resin content of 10–20 wt. %, and polyvinyl chloride resin particles of a size of 1–15 μm were dispersed in an amount of 5–20 wt. %. The elastic blade 26 was obtained by dipping the base blade member 26a into the resin dispersion, followed by drying, thus forming a coating layer of a thickness of 20 μm.

Elastic blade 26 was maintained in contact under an elastic deformation, with the developing sleeve 21 of the developing device 5, with a linear pressure of 17 g/cm. The coated layer 26b, being thinly formed on the base blade member 26a of urethane rubber, did not hinder the elasticity thereof, so that the toner layer 25 could be formed uniformly along the longitudinal direction of the developing sleeve 21.

The developing device 5 provided with the elastic blade 26 of the above-mentioned configuration was incorporated in the image forming apparatus shown in FIG. 2 and was subjected to continuous printing operations. There could be obtained images with a reflective density of 1.4 or higher, uniform in the longitudinal direction of the developing sleeve 21, even immediately after the start of use of the developing device 5 or immediately after the toner replenishment into the container 24, and the images were satisfactory, without ghost or background smudge.

Under a low humidity condition of 10% RH at 15° C. an elastic blade 26 consisting of urethane rubber alone provided a frictional charge of about −8 μC/g on the toner 24, while a blade of urethane rubber coated solely with polyamide resin provided a larger charge of about −15 μC/g. On the other hand, the elastic blade 26 of the present embodiment provided an intermediate frictional charge of about −11 μC/g, so that there was not observed the density loss resulting from the excessive charging of the toner 24, or the speckled unevenness due to the coagulation of the toner 24. After 20,000 prints, the coated layer 26b of the elastic blade 26 of the present embodiment still had a thickness of ca. 8 μm, thus still retaining the ability of giving frictional charge to the toner 24.

In the foregoing embodiment, the elastic blade was composed of a base blade member 26a of urethane rubber surfacially coated with a coating layer 26b of polyamide resin in which powdered polyvinyl chloride resin was dispersed, but the base blade member 26a may instead be composed of silicone rubber or butyl rubber. Also the coated layer 26b may be obtained by mixing or dispersing a powdered substance negatively chargeable to the toner in the triboelectric series, such as phenolic resin, epoxy resin, polyfluorated vinylidene resin, polyfluoroethylene or polytetrafluoroethylene in a binder substance positively chargeable to the toner in the triboelectric series such as polyvinyl alcohol or cellulose, or by mixing or blending positively chargeable powdered resin into negatively chargeable binder resin, in such a manner as to obtain a positive charge in total to the toner 24. The substance to be dispersed in the coated layer 26b is not limited to the powdered resin, but may also be a pigment, a dye or silica, that is friction charged to the polarity opposite to that of the binder resin.

Also, in case positively chargeable toner is employed, the coated layer 26b of the elastic blade 26 may be prepared by mixing positively chargeable resin and negatively chargeable resin in such a manner as to obtain a negative chargeability in total.

Figure 3:
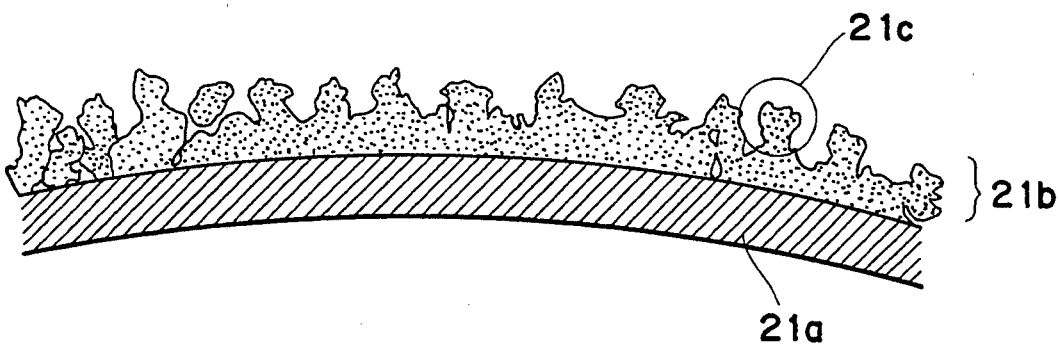
FIG. 3 is a partial magnified cross-sectional view of another embodiment of the present invention.
Figure 4:
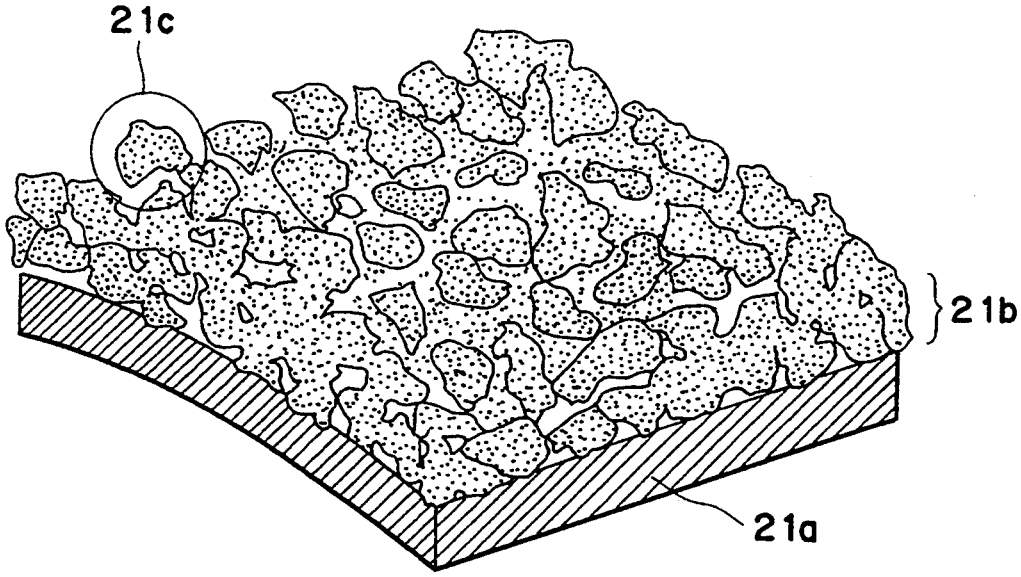
FIG. 4 is a partial magnified perspective view of the sleeve shown in FIG. 3.

FIG. 3 is a magnified cross-sectional view of the surfacial area of a developing sleeve in another embodiment of the developing device of the present invention, and FIG. 4 is a magnified perspective view of said developing sleeve.

The present embodiment employs a developing sleeve 21, composed of a base member 21a of an aluminum pipe of a diameter of 16 mm (surfacially roughed with alundum particles of #100 mesh), coated thereon with a resin layer 21b containing conductive particles. Resin layer 21b has a volume resistivity of $10^2-10^{-3}$ Ωcm and has an irregular surface with protrusion of secondary particles consisting of conductive particles and resin. Such sleeve is described in U.S. Pat. No. 4,989,044.

Developing sleeve 21, surfacially bearing the resin layer 21b containing the conductive particles, can reduce the contact resistance between the toner 24 and the surface of the sleeve 21 and can leak the eventual excessive charge of the toner 24 through the conductive particles in the resin layer 21b, thereby avoiding the density loss etc. resulting from the excessive charging of the toner 24. It is therefore possible to increase the charge generation by the coated layer 26b of the elastic blade 26, thereby elevating the image density at the start of use of the developing device.

In the following there will be explained a specific example of another preferred embodiment of the present invention.

Resin liquid, prepared by dispersing a suitable amount of carbon black particles and graphite particles as the conductive particles into phenolic resin, was coated with a thickness of 5 μm, on a base sleeve member 21a composed of an aluminum pipe of a diameter of 16 mm, to obtain a conductive resin layer 21b, thereby completing a developing sleeve 21. A magnet 22 with four magnetic poles of 600–850 Gauss was placed therein.

An elastic blade 26 was composed of a base blade member 26a of urethane rubber of a thickness of 1.3 mm and a hardness of 65° (JIS-A), surfacially coated with a layer 26b of polyamide resin binder in which particles of polyfluorinated vinylidene resin (negatively chargeable by friction with toner) were dispersed with a weight ratio of 10 : 1. Layer 26b is charged positively in total, by the friction with the toner.

In a similar continuous printing operation as in the foregoing embodiment, with the same toner as therein, the elastic blade 26 of the present embodiment showed a higher charge providing property to the negatively chargeable toner 24, than in the elastic blade employed in the foregoing embodiment. Also, under the low humidity condition, there were obtained satisfactory images without density loss or speckled unevenness due to the coagulation of the toner 24, and particularly conspicuous was the elevated image density at the start of use of the developing device.

In the foregoing example, the resin layer 21b containing conductive particles, on the surface of the developing sleeve 21, was composed of carbon black particles and graphite particles dispersed in suitable amounts in phenolic resin, but such conductive particles may also be composed of powdered metal, $TiO_2$, $SnO_2$ or conductive ceramics of Si alkoxide. Also, the resin should preferably be of good dispersing property and good antiabrasive property, and can be, for example, epoxy resin, polyethylene, polypropylene, methacrylic resin or polyacetal.

Figure 5:
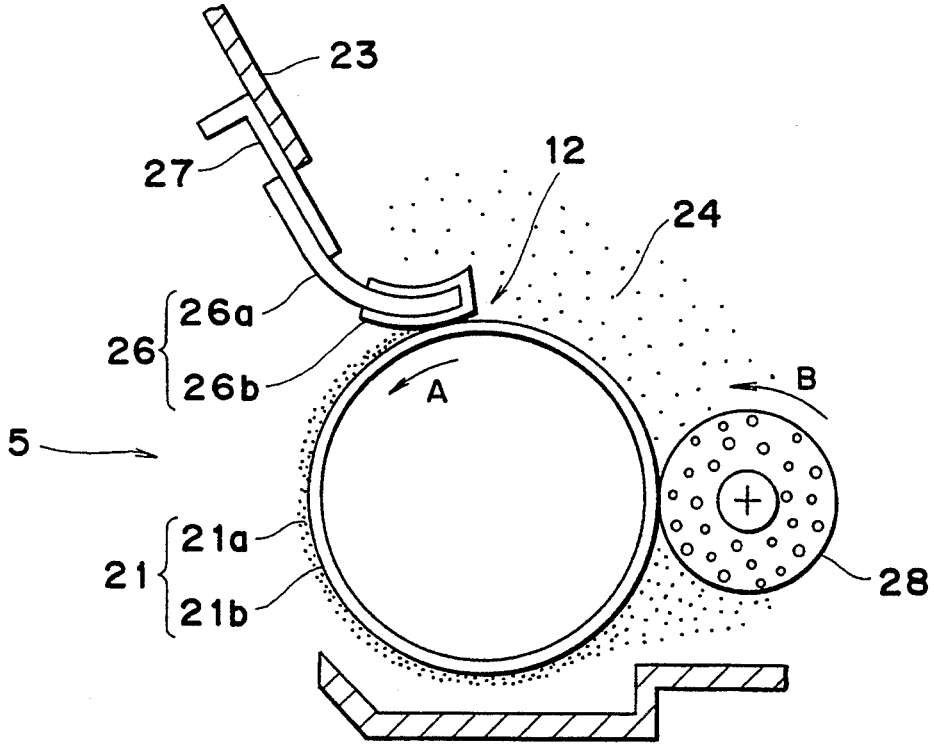
FIG. 5 is a partial cross-sectional view of still another embodiment of the present invention.

FIG. 5 is a partial cross-sectional view of still another embodiment of the developing device of the present invention.

In this embodiment, an elastic blade 26, having a coated layer 26b capable of charging negatively chargeable toner 24, is applied to a developing device employing non-magnetic toner as the one-component developer.

In this embodiment, a developing sleeve 21 was composed of a base member 21a of a stainless steel pipe and a conductive resin layer 21b formed thereon and containing conductive particles as shown in FIGS. 3 and 4, and had an external diameter of 16 mm. Developing sleeve 21 was driven in a direction A, and a coating roller 28 of foamed polyurethane with an external diameter of 8 mm was pressed thereon. Coating roller 28 was rotated in a direction B, and served to peel off the toner 24 remaining on the developing sleeve 21 after development and to supply fresh toner 24 from the container 23 to the developing sleeve 21.

As explained above, the present embodiment employed negatively chargeable non-magnetic toner, composed of styrene-acrylic resin containing red azo pigment therein and having the center of particle size distribution in the range of 7–10 μm.

The elastic blade 26 was obtained by forming, on a base blade member of urethan rubber of a thickness of 1 mm and a hardness of 65° (JIS-A), a coated layer 26b of a thickness of 20 μm, consisting of polyamide resin binder positively chargeable by friction with the toner 24 and silica powder negatively chargeable by the friction with the toner 24 dispersed in said binder, and being chargeable, positively in total, by the friction with said toner 24. The elastic blade was contacted with the developing sleeve 21 with a linear pressure of 21 g/cm.

The developing device of the above-explained configuration was incorporated in the image forming apparatus shown in FIG. 2, and was subjected to continuous printing operations. There could be obtained images of a uniform reflective density of 1.2 or higher along the longitudinal direction of the developing sleeve 21, even in the initial stage of use of the developing device or even immediately after the toner replenishment into the developing container 23, and the images were free from ghost or background smudge.

The non-magnetic toner employed in the foregoing embodiment, lacking the internal high-melting substance as in the case of magnetic toner, tends to cause fusion at the nip between the developing sleeve 21 and the elastic blade 26, and to generate streaks on the developed image. However, such streaks were not observed in this embodiment, because the contact pressure could be made as low as 21 g/cm.

In the following description there will be explained an elastic blade having a surface layer 26b which contains a first substance charged to a polarity opposite to the aforementioned predetermined polarity by friction with the one-component developer and a second substance serving as a solid lubricant, and is charged in total to a polarity opposite to said predetermined polarity.

In the developing device shown in FIG. 2, the present embodiment is featured by a fact that the coating layer 26b of the elastic blade 26 is formed by dispersing, in polyamide resin binder, powdered silicone resin such as Tospal manufactured by Toshiba Silicone Co., Ltd., as lubricating particles. More specifically, the elastic blade 26 was obtained by forming, on a base blade member 26a of urethane rubber of a thickness of 1.3 mm and a hardness of 65° (JIS-A), a coating layer 26b of a thickness of 20 μm composed of polyamide resin in which silicone resin particles were dispersed. The particles were exposed on the surface of the resin layer 26b.

The polyamide resin is positively chargeable with respect to the negatively chargeable toner 24, and the silicone resin serves as a solid lubricant to the toner 24. Thus, the coated layer 26b, consisting of polyamide resin and silicone resin particles dispersed therein, is charged positively in total by friction with the toner, thereby providing the toner with suitable negative frictional charge, and also shows lubricating property to the toner 24 and the developing sleeve 21.

Consequently, the elastic blade 26 provided with such coated layer 26b does not show the sticking thereof to the developing sleeve 21 or the peeling of the coated layer 26b even at the start of use of the developing device, and can also provide also the upper part of the toner layer 25 with a suitable negative frictional charge, without excessive charging of the toner 24 even under low humidity conditions, whereby a satisfactory high-density image can be obtained without ghost or background smudge by the development with said toner layer 25.

The coated layer 26b, provided thinly on the base blade member 26a of urethane rubber, does not hinder the elasticity thereof and allows the apparatus of the present invention to obtain a thin toner layer uniform in the longitudinal direction of the developing sleeve 21.

In the above-explained configuration, if the size of the silicone resin particles, or the lubricating particles, exceeds 50 μm, the contact pressure of the elastic blade 26 on the developing sleeve 21 tends to become uneven in the longitudinal direction of the developing sleeve 21, so that the thin toner layer 25 formed on the developing sleeve 21 tends to become uneven in thickness. On the other hand, if the size is less than 0.1 μm, the lubricating particles are not exposed on the surface of the coated layer 26b, so that the lubricating effect becomes reduced. Also, sufficient charge generating ability to the toner 24 cannot be obtained if the content of the lubricating particles in the coated layer 26b exceeds 500 wt. %, while the toner 24 is excessively charged due to insufficient lubricating property if the content is less than 1 wt. %.

The thickness of the surface layer 26b is preferably about 150 μm or less, since a thickness exceeding 200 μm hinders elastic deformation of the elastic blade 26, whereby the contact pressure thereof to the developing sleeve 21 tends to become uneven in the longitudinal direction of the sleeve 21 and the toner layer 25 tends to become uneven in thickness. The friction coefficient of the elastic blade 26 to the developing sleeve 21 should be 3.0 or less since the coated layer 26b may be otherwise peeled off at the start of use of the developing device 5, and preferably 1.0 or less in consideration of the transportability of the toner 24.

In the following description there will be explained a specific example of the present embodiment.

As in the foregoing embodiment, the developing sleeve 21 was prepared by roughing the surface of an aluminum pipe of a diameter of 16 mm with alundum particles of #100 mesh, and a magnet with four magnetic poles of 600–850 Gauss was positioned therein. Also, the negatively chargeable toner 24 was similarly prepared by blending magnetite in styrene-acrylate resin, crushing the same to a particle size distribution of 5–8 μm and adding silica in an amount of 1.2 wt. %.

The elastic blade 26 was prepared by dispersing particles of silicone resin (Tospal) of a particle size of 1–15 μm, in an amount of 5–20 wt. %, in methanolic solution of alcohol-soluble polyamide resin such as Platamide or Toresin (with a resin content of 10–20 wt. %), and dipping a base blade member 26a of urethane rubber of a thickness of 1.3 mm and a hardness of 65° (JIS-A) in said dispersion followed by drying to form a coated layer 26b of a thickness of 20 μm. Elastic blade 26 was contacted, under elastic deformation, with the developing sleeve 21 with a linear pressure of 17 g/cm. The sliding friction coefficient between the elastic blade 26 and the developing sleeve 21 in this state was 0.3.

The developing device 5 shown in FIG. 1, equipped with the above-explained elastic blade 26, was incorporated in the image forming apparatus shown in FIG. 2 and was subjected to continuous printing operations. There could be obtained images of a reflective density of 1.4 or higher, uniform in the longitudinal direction of the developing sleeve 21 even in the initial stage of use of the toner 24 or immediately after the toner replenishment into the developing container 23, without adhesion of the coated layer 26b to the developing sleeve 21 or peeling of layer 26b. The obtained images were satisfactory, without ghost or background smudge.

Also, under a low humidity condition of 10 %RH at 15° C., an elastic blade consisting solely of urethane rubber provided a frictional charge of about −8 μC/g on the toner 24, while an elastic blade composed of urethane rubber coated solely with polyamide resin provided a frictional charge as high as about −15 μC/g, but the elastic blade of the present embodiment provided an intermediate frictional charge of −11 μC/g, whereby there could be prevented the density loss resulting from excessive charging of the toner 24 or the speckled unevenness resulting from coagulation of the toner 24. After 20,000 printing operations, the coated layer 26b of the elastic blade of the present embodiment had a thickness of ca. 8 μm, still capable of providing the toner with the frictional charge.

In the foregoing embodiment, the elastic blade 26 was composed of a base blade member 26a of urethane rubber surfacially coated with a layer 26b of polyamide resin binder in which silicone resin particles were dispersed, but the base blade member 26a may be composed, instead of urethane rubber, of silicone rubber, butyl rubber, elastic resin, alloy or metal such as phosphor bronze.

Also, the coated layer 26b may be obtained either by dispersing lubricating solid particles such as powdered polyethylene or powdered stainless steel in a resinous binder such as polyvinyl alcohol, cellulose or acrylic resin which is positively chargeable in the triboelectric series with respect to the toner 24, or by dispersing positively chargeable resin particles in lubricating binder resin in such a manner that the coated layer 26b is charged, positively in total, by friction with the toner 24 and maintains lubricating property to the toner 24 and the developing sleeve 21.

In case the toner 24 is positively chargeable, the coated layer 26b can be composed of a binder resin chargeable negatively by the friction with the toner 24, such as tetrafluoroethylene or polyvinyl chloride, and solid lubricant particles dispersed therein, in such a manner that the layer 26b is charged negatively in total.

In a next example, there was employed a sleeve shown in FIGS. 3 and 4. An elastic blade 26, which is the same as in the foregoing example except that the coated layer 26b was formed by dispersing polyethylene particles of a particle size of 2–3 μm in a polyamide resin binder with a weight ratio of 1:10, was incorporated in the developing device 5 shown in FIG. 2 and was subjected to continuous printing operations in the image forming apparatus shown in FIG. 1.

Also in this example, there could be obtained images with a reflective density of 1.4 or highest, uniform in the longitudinal direction of the developing sleeve 21, even in the initial period of use of the toner 24 or immediately after the toner replenishment into the developing container 23, without adhesion of the coated layer 26b to the developing sleeve 21 or peeling of said coated layer 26b even at the start of use of the developing device 5, and the obtained images were satisfactory without ghost or background smudge. Even when the toner 24 is excessively charged, the excessive charge thereof can be leaked through the conductive particles in the resin layer 21b of the developing sleeve 21, so that the charge providing character of the coated layer 26b of the elastic blade 26 can be elevated without the density loss resulting from the excessive charging of the toner 24. Particularly conspicuous was the elevated image density at the initial stage of use of the developing device 5.

Also under a low humidity condition of 10 %RH at 15° C., the elastic blade 26 of the present embodiment provided an intermediate frictional charge of about −11 μC/g, whereby there could be prevented the density loss resulting from excessive charging of the toner 24 or the speckled unevenness resulting from coagulation of the toner 24. After 20,000 printing operations, the coated layer 26b of the elastic blade 26 still had a thickness of ca. 8 μm and was still capable of providing the toner 24 with frictional charge.

A next example is the same as the foregoing one except that the coated layer 26b of the elastic blade 26 in the developing device shown in FIG. 5 was composed of a polyamide resin and lubricating stainless steel particles of a size of 2–3 μm dispersed therein with a weight ratio of 10:1. In continuous printing operations in the image forming apparatus shown in FIG. 2, there could be obtained images with a reflective density of 1.4 or higher, uniform in the longitudinal direction of the developing sleeve 21 even in the initial period of use of the toner 24 or immediately after the toner replenishment into the developing container 23, without adhesion of the coated layer to the developing sleeve 21 or peeling of said coated layer even in the initial period of use of the developing device 5, and the obtained images were satisfactory without ghost or background smudge.

The coated layer 26b of the present example, formed with a thickness of 20 μm in the elastic blade 26, still retained a thickness of ca. 10 μm even after 20,000 printing operations, with sufficient ability to provide the toner 24 with frictional charge.

As explained in the foregoing, the non-magnetic toner employed in the present embodiment tends to cause fusion at the nip between the developing sleeve 21 and the elastic blade 26, thereby generating streaks on the developed image, because of the absence of the internal high-melting substance as in the magnetic toner, but such streaks could be avoided in the present embodiment because the contact pressure could be made as low as 21 g/cm. Besides the above-mentioned drawback could be more securely avoided because the toner 24 did not stop at the blade 26 because of the satisfactory lubricating property thereof.

In the following there will be explained an elastic blade 26 with a surface layer 26b which contains a binder substance chargeable to a polarity opposite to the aforementioned predetermined polarity by the friction with the one-component developer and substantially spherical particles dispersed in said binder substance, and which is charged, in total, to a polarity opposite to said predetermined polarity by the friction with said one-component developer.

The present embodiment is featured, in the developing device shown in FIG. 2, in that the coated layer 26b of the elastic blade 26 is formed by dispersing, in polyamide resin, substantially spherical silicone resin particles as solid lubricating property (spherical Tospal particles). More specifically, the elastic blade 26 was obtained by forming, on a base blade member 26a of urethane rubber of a thickness of 1.3 mm and a hardness of 65° (JIS-A), a coated layer 26b of a thickness of 20 μm, composed of polyamide resin binder in which substantially spherical silicone resin particles were dispersed.

The polyamide resin is positively chargeable with respect to the toner 24 and is capable of generating a sufficient frictional charge on the toner 24 immediately after the start of use or immediately after the replenishment into the developing container 23. Besides the fact that the silicone resin particles have solid lubricating property and are substantially spherical, the sliding property on the developing sleeve 21 is improved even when the elastic blade 26 is in direct contact with the developing sleeve 21 in the initial stage of use of the developing device 5, whereby the peeling of the coated layer 26b by the motion of the developing sleeve 21 can be more securely prevented.

Also, in the repeated printing operations, as the silicone resin particles are substantially spherical to provide improved sliding property between the coated layer 26b and the developing sleeve 21, the transportation of the toner 24 by the developing sleeve 21 is further facilitated. Thus, there can be more effectively prevented the stay of the toner 24 at the elastic blade 26, and the excessive charging of the toner 24.

As explained above, the present embodiment can provide the upper part of the thin toner layer 25, formed on the developing sleeve 21, with sufficient negative frictional charge, and can provide satisfactory images of a high density, without the density loss resulting from the excessive charging of the toner 24 or the speckled unevenness resulting from coagulation of the toner 24, even under a low humidity condition. The coated layer 26b, containing the spherical silicone resin particles dispersed in polyamide resin, being thinly formed on the base blade member 26a, does not hinder the elasticity thereof, whereby a thin toner layer 25 can be formed uniformly in the longitudinal direction of the developing sleeve 21.

If the silicone resin particles are not spherical but have sharply pointed parts, the elastic blade may damage the developing sleeve 21 whereby the obtained image may show longitudinally running streaks. However silicone resin particles having a radius of curvature of 0.1 μm or larger in the portion contacting the developing sleeve 21 did not cause noticeable damages on the developing sleeve, and the obtained images did not show such streaks. On the other hand, the particles showing a nearly planar state in the contacting portion, with a radius of curvature exceeding 100 μm, do not provide sufficient sliding property to the developing sleeve 21 or to the toner 24, and the proportion of toner that cannot contact the coated layer **26*b* increases, so that the toner layer 25 on the developing sleeve 21** tends to show unevenness in the frictional charge.

When the particle size of the substantially spherical silicone resin particles exceeds 50 μm, the contact pressure of the elastic blade 26 onto the developing sleeve 21 tends to become uneven in the longitudinal direction thereof, so that the thin toner layer 25 formed on the developing sleeve 21 tends to become uneven in thickness. On the other hand, when said particle size becomes smaller than 0.1 μm, the lubricating effect is lowered because the silicone resin particles do not appear sufficiently on the surface of the coated layer **26*b***. Consequently, the size of the silicone resin particles is preferably within a range of 0.1–50 μm, comparable to the size of the toner.

If the silicone resin particles, dispersed in the coated layer **26*b*, are softer than the toner 24, the lubricating effect is limited because such particles are rapidly scraped off. On the other hand, if said particles are hard and have pointed portions, the developing sleeve 21 is rapidly scraped off. Consequently, the particle surface should be smoother as the particles become harder. Also, the silicone resin particles cannot show sufficient charge providing property to the toner 24 if the content of the particles in the coated layer exceeds 500 wt. %, and cannot provide sufficient lubricating property, thus causing excessive charging of the toner 24** if the content is less than 1 wt. %.

The thickness of the coated layer **26*b* of the elastic blade 26 should be 200 μm or less, preferably 150 μm or less, as explained before. Also, the sliding friction coefficient of the elastic blade 26, relative to the developing sleeve 21**, should be 3.0 or less, preferably 1.0 or less.

In the following description there will be explained a specific example of the present embodiment.

As in the foregoing examples explained in relation to FIG. 2, the developing sleeve 21 was prepared by roughing the surface of an aluminum pipe with a diameter of 16 nun with alundum particles of #100 mesh, and a magnet having four magnetic poles of 600–850 Gauss was placed therein. The negatively chargeable toner 24 was also obtained by blending magnetite, in 100 wt. %, to styrene-acrylate resin, crushing the mixture to a particle size distribution of 5–8 μm and adding silica in an amount of 1.2 wt. %.

The elastic blade 26 was prepared by dispersing substantially spherical silicone resin particles of a size of 1–15 μm (spherical Tospal particles), in an amount of 5–200 wt. %, in methanolic solution of alcohol-soluble polyamide resin such as Platamide or Toresin (resin content 10–20 wt. %), and dipping a base blade member **26*a* of urethane rubber with a thickness of 1.3 mm and a hardness of 65° (JIS-A) in said dispersion, followed by drying to obtain the coated layer 26*b* of a thickness of 20 μm. The elastic blade was contacted, under elastic deformation, with the developing sleeve with a linear pressure of 17 g/cm. The sliding friction coefficient between the elastic blade 26** and the developing sleeve in this state was 0.3.

The developing device 5 shown in FIG. 1, equipped with the elastic blade 26 of the above-explained configuration, was incorporated in the image forming apparatus shown in FIG. 2 and was subjected to continuous printing operations. There could be obtained images with a reflective density of 1.4 or higher, uniform in the longitudinal direction of the developing sleeve 21, even in the initial stage of use of the developing device 5 or immediately after the toner replenishment into the developing container 23, without adhesion of tile coated layer to the developing sleeve 21 or the peeling of the coated layer even in the initial stage of use of the developing device 5. Also, the obtained images were satisfactory, without ghost or background smudge.

Under a low humidity condition of 10 %RH at 15° C., an elastic blade consisting solely of polyurethane provided a frictional charge of about −8 μC/g on the toner 24, while an elastic blade consisting of urethane rubber coated solely with polyamide resin provided a frictional charge as high as −15 μC/g, but the elastic blade 26 of the present embodiment provided an intermediate charge of ca. −11 μC/g, thereby preventing the density loss resulting from excessive charging of the toner 24 or the speckled unevenness resulting from coagulation of the toner 24. After 20,000 printing operations, the coated layer **26*b* of the elastic blade 26 of the present embodiment still retained a thickness of ca. 8 μm, and was thus still capable of providing the toner 24** with the frictional charge.

The base blade member **26*a* of urethane rubber employed in the elastic blade 26 of the present embodiment may be replaced, for example, by silicone rubber, butyl rubber, elastic resin, or alloy or metal such as phosphor bronze. Also the coated layer 26*b* may be composed by dispersing substantially spherical particles of fluorinated resin such as tetrafluoroethylene, polyethylene or stainless steel powder, in a positively chargeable binder substance to the toner 24**, such as polyvinyl alcohol, cellulose or acrylic resin.

The next example was same as the foregoing one, except that the sleeve explained in FIGS. 3 and 4 was employed and that the coated layer **26*b* of the elastic blade 26 was formed by dispersing, in polyamide resin binder, substantially spherical particles of polyfluorinated vinylidene resin of a particle size of 2–3 μm with a weight ratio of 10:1. Elastic blade 26 was employed in the developing device 5 shown in FIG. 2, and was subjected to continuous printing operations in the image forming apparatus shown in FIG. 1**.

Also in this example, there could be obtained images with a reflective density of 1.4 or higher, uniform along the longitudinal direction of the developing sleeve 21 even in the initial stage of use of the toner 24 or immediately after the toner replenishment into the developing container 23, without the adhesion of the coated layer to the developing sleeve 21 or the peeling of said coated layer even at the start of use of the developing device 5, and the obtained images were satisfactory without ghost or background smudge. Particularly conspicuous was the elevated image density at the start of use of the developing device 5.

Also, under a low humidity condition of 10 %RH at 15° C., the elastic blade of the present embodiment provided an intermediate frictional charge of ca. −11 μC/g thereby avoiding the density loss resulting from the excessive charging of the toner 24 or the speckled unevenness resulting from the coagulation of the toner 24. After 20,000 printing operations, the coated layer **26*b* of the elastic blade 26 still retained a thickness of ca. 8 μm, and was thereby still capable of providing the toner 24** with frictional charge.

In a next example, in the developing device 5 shown in FIG. 5, the coated layer **26*b* of the elastic blade 26 was formed by dispersing substantially spherical silica particles of a particle size of 3–15 μm in polyamide resin binder, and was subjected to continuous printing operations in the image forming apparatus shown in FIG. 1**.

Also in this example there could be obtained images with a reflective density of 1.2 or higher, uniform in the longitudinal direction of the developing sleeve 21 even in the initial stage of use of negatively chargeable non-magnetic toner or immediately after the toner replenishment into the developing container 23, without adhesion of the coated layer to the developing sleeve 21 or peeling of said coated layer even at the start of use of the developing device 5, and the obtained images were satisfactory, without ghost or background smudge.

In the present example, the coated layer **26*b* formed with a thickness of 20 μm on the elastic blade 26 still retained a thickness of ca. 10 μm even after 20,000 printing operations, thus still being capable of providing the toner 24** with frictional charge.

In case the base blade member **26*a* is composed of rubber in the foregoing embodiments, the thickness of the surface layer 26*b* is preferably 15% or less of the thickness of the base blade member 26*a*, in order not to hinder the elasticity thereof in the contact of the blade 26 with the sleeve 21**.

The present invention, which has been explained by various embodiments thereof, may be applied either to a cartridge integrally containing principal image forming means and rendered detachable from the image forming apparatus, or to an image forming apparatus in which the image forming means are directly incorporated therein. In case of application to such process cartridge, since the toner is renewed to the one without frictional charge at the replacement of said cartridge, it is extremely effective to provide the elastic blade in said process cartridge with a coated layer composed, for example, of a mixture of positively and negatively chargeable substances for providing the toner with a suitable frictional charge, in order to obtain satisfactory images without the density loss resulting from the excessive charging of the toner or the speckled unevenness resulting from coagulation of the toner.

What is claimed is:

1. A developing device for developing an electrostatic latent image, comprising:

a developer bearing member for bearing and transporting a one-component developer to a developing area, said developer bearing member being adapted to frictionally charge the one-component developer to a predetermined polarity for developing an electrostatic latent image; and a defining member for limiting a thickness of the one-component developer transported by said developer bearing member to the developing area, said defining member being in contact with the developer bearing member to form a nip therebetween, through which the one-component developer passes;

wherein said defining member includes an elastic base member and a surface layer formed on said elastic base member and serving to form said nip, and said surface layer includes a first substance charged to a polarity opposite to said predetermined polarity by friction with the one-component developer, and a second substance charged to a polarity the same as said predetermined polarity by friction with the one-component developer, and is charged, in total, to a polarity opposite to said predetermined polarity, by friction with said one-component developer.

2. A developing device according to claim 1, wherein said elastic base member is composed of rubber, and said first and second substances are composed of substances other than rubber.

3. A developing device according to claim 2, wherein a thickness of said surface layer is smaller than that of the elastic base member.

4. A developing device according to claim 3, wherein the first substance of the surface layer is a binder, in which the second substance is dispersed as particles.

5. A developing device for developing an electrostatic latent image, comprising:

a developer bearing member for bearing and transporting a one-component developer to a developing area, said developer bearing member being adapted to frictionally charge the one-component developer to a predetermined polarity for developing an electrostatic latent image; and a defining member for limiting a thickness of the one-component developer transported by said developer bearing member to the developing area, said defining member being in contact with the developer bearing member to form a nip therebetween, through which the one-component developer passes;

wherein said defining member includes an elastic base member and a surface layer formed on said elastic base member and serving to form said nip, and said surface layer includes a first substance charged to a polarity opposite to said predetermined polarity by friction with the one-component developer, and a second substance serving as a solid lubricant, and is charged, in total, to a polarity opposite to said predetermined polarity, by friction with said one-component developer.

6. A developing device according to claim 5, wherein the first substance of the surface layer is a binder, in which the second substance is dispersed as particles.

7. A developing device according to claim 6, wherein the particles of the second substance are substantially spherical.

8. A developing device according to claim 6 or 7, wherein said elastic base member is composed of rubber, and said first and second substances are composed of substances other than rubber.

9. A developing device according to claim 8, wherein a thickness of said surface layer is smaller than that of the elastic base member.

10. A developing device according to claim 9, wherein a sliding friction coefficient of said surface layer with respect to the developer bearing member is 3 or less.

11. A developing device according to claim 10, wherein said sliding friction coefficient is 1 or less.

12. A developing device for developing an electrostatic latent image, comprising:

a developer bearing member for bearing and transporting a one-component developer to a developing area, said developer bearing member being adapted to frictionally charge the one-component developer to a predetermined polarity for developing an electrostatic latent image; and a defining member for limiting a thickness of the one-component developer transported by said developer bearing member to the developing area, said defining member being in contact with the developer bearing member to form a nip therebetween, through which the one-component developer passes;

wherein said defining member includes an elastic base member and a surface layer formed on said elastic base member and serving to form said nip, and said surface layer includes a binder substance charged to a polarity opposite to said predetermined polarity by friction with the one-component developer, and substantially spherical particles dispersed in said binder substance, and is charged, in total, to a polarity opposite to said predetermined polarity by friction with the one-component developer.

13. A developing device according to claim 12, wherein said elastic base member is composed of rubber, and said binder substance and particles are composed of synthetic resins other than rubber.

14. A developing device according to claim 12, wherein a thickness of said surface layer is smaller than that of the elastic base member.

15. A defining member for limiting a thickness of a one-component developer borne and transported by a developer bearing men, her to a developing area, comprising:

an elastic base member; and a surface layer provided on said elastic base member and adapted to contact the developer bearing member for forming a nip therebetween, through which the one-component developer passes, said surface layer being adapted to frictionally charge the one-component developer to a predetermined polarity for developing an electrostatic latent image;

wherein said surface layer contains a first substance chargeable to a polarity opposite to said predetermined polarity by friction with the one-component developer, and a second substance chargeable to a polarity the same as said predetermined polarity by friction with the one-component developer, and is charged, in total, to a polarity opposite to said predetermined polarity by friction with the one-component developer.

16. A defining member according to claim 15, wherein said elastic base member is composed of rubber, and said first and second substances are composed of materials other than rubber.

17. A defining member according to claim 16, wherein a thickness of the surface layer is smaller than that of the elastic base member.

18. A defining member according to claim 17, wherein the first substance of the surface layer is a binder, in which the second substance is dispersed as particles.

19. A defining member for limiting a thickness of a one-component developer borne and transported by a developer bearing member to a developing area, comprising:

an elastic base member; and a surface layer provided on said elastic base member and adapted to contact the developer bearing member for forming a nip therebetween, through which the one-component developer passes, said surface layer being adapted to frictionally charge the one-component developer to a predetermined polarity for developing an electrostatic latent image;

wherein said surface layer contains a first substance chargeable to a polarity opposite to said predetermined polarity by friction with the one-component developer, and a second substance serving as a solid lubricant, and is charged, in total, to a polarity opposite to said predetermined polarity by friction with the one-component developer.

20. A defining member according to claim 19, wherein said first substance in the surface layer is a binder, in which said second substance is dispersed as particles.

21. A defining member according to claim 20, wherein the particles of said second substance are substantially spherical.

22. A defining member according to claim 20 or 21, wherein said elastic base member is composed of rubber, and said first and second substances are composed of materials other than rubber.

23. A defining member according to claim 22, wherein a sliding friction coefficient of said surface layer to the developer bearing member is 3 or less.

24. A defining member according to claim 23, wherein said sliding friction coefficient is 1 or less.

25. A defining member for limiting a thickness of a one-component developer borne and transported by a developer bearing member to a developing area, comprising:

an elastic base member; and a surface layer provided on said elastic base member and adapted to contact the developer bearing member for forming a nip therebetween, through which the one-component developer passes, said surface layer being adapted to frictionally charge the one-component developer to a predetermined polarity for developing an electrostatic latent image;

wherein said surface layer contains a binder substance chargeable to a polarity opposite to said predetermined polarity by friction with the one-component developer, and substantially spherical particles dispersed in said binder substance, and is charged, in total, to a polarity opposite to said predetermined polarity by friction with the one-component developer.

26. A defining member according to claim 25, wherein said elastic base member is composed of rubber, and said binder substance and said particles are composed of materials other than rubber.

27. A defining member according to claim 26, wherein a thickness of said surface layer is smaller than that of the elastic base member.

* * * * *

UNITED STATES PATENT AND TRADEMARK OFFICE

CERTIFICATE OF CORRECTION

PATENT NO. :5,353,104

DATED :October 4, 1994

INVENTOR(S) :Kato et al.

It is certified that error appears in the above-indentified patent and that said Letters Patent is hereby corrected as shown below:

COLUMN 1

Line 19, "constituting" should read --constituting a--.

COLUMN 4

Line 12, "drum After" should read --drum 3. After--.

COLUMN 6

Line 3, "invention" should read --invention.--.

COLUMN 8

Line 48, "said" should be deleted.

COLUMN 11

Line 24, "highest," should read --higher,--.

UNITED STATES PATENT AND TRADEMARK OFFICE

CERTIFICATE OF CORRECTION

PATENT NO. 5,353,104

DATED October 4, 1994

INVENTOR(S) Kato et al.

It is certified that error appears in the above-indentified patent and that said Letters Patent is hereby corrected as shown below:

COLUMN 13

Line 55, "16 nun" should read --16 mm--.

COLUMN 17

Line 36, "men,her" should read --member--.

Signed and Sealed this

Twenty-fifth Day of April, 1995

*Attest:*

BRUCE LEHMAN

*Attesting Officer*

*Commissioner of Patents and Trademarks*